US005964506A

United States Patent [19]

Coates et al.

[11] Patent Number: 5,964,506

[45] Date of Patent: Oct. 12, 1999

[54] INFANT PROPPING PLAY SEAT

[76] Inventors: Michael R. Coates; Donna F. Coates, both of 5404 80th Ave. Cir. E, Palmetto, Fla. 34221

[21] Appl. No.: 09/094,116

[22] Filed: Jun. 9, 1998

[51] Int. Cl.[6] ..... A47C 31/00

[52] U.S. Cl. ..... 297/484; 297/467; 297/183.7; 297/228.13; 5/655; 128/869

[58] Field of Search ..... 297/464, 467, 297/468, 487, 484, 352, 183.7, 183.1, 219.1, 228.13, DIG. 6, 219.12; 5/655; 128/869, 870, 874

[56] References Cited

U.S. PATENT DOCUMENTS

| | | |
|---|---|---|
| 1,769,722 | 7/1930 | Sutton . |
| 2,555,566 | 6/1951 | Bleck . |
| 2,645,781 | 7/1953 | Mover . |
| 2,655,982 | 10/1953 | Christensen . |
| 3,840,916 | 10/1974 | Jennings . |
| 3,936,075 | 2/1976 | Jelliffe . |
| 4,589,407 | 5/1986 | Koledin et al. . |
| 5,148,563 | 9/1992 | Klearman et al. . |
| 5,553,915 | 9/1996 | Stamatakis . |

*Primary Examiner*—Milton Nelson, Jr.
*Attorney, Agent, or Firm*—Dorothy S. Morse

[57] ABSTRACT

A device and method contemplated for vertically positioning infants who do not have the muscular control necessary to sit upright unassisted for extended periods of time. The device supports such infants in an essentially upright position so that they can more easily interact with people and objects adjacent to them without an adult or older child having to hold them and support them about the waist. The device comprises a rigid bottomless U-shaped support having a slightly rearwardly inclined inside back surface, a wide chest strap, flexible padding attached against the U-shaped support, and sides which are approximately half the height of its back. The bottom edges of the U-shaped support are outwardly flared and wedge shaped to prevent the device from unpredictably moving backward and laterally as a result of abrupt infant movement. Applications may include, but are not limited to, use with infants between the ages of three and eight months by workers in child care centers and nurseries so that the infants can be positioned to view the activities of older children; by parents who have the responsibility of raising twins, triplets, or even more infants at one time; by parents of a single infant when the parents need to accomplish tasks which would be impossible while holding the infant; and by those caring for children older than eight months who have medical conditions causing weakened muscular control that would not otherwise allow them to sit upright on their own for extended periods of time.

19 Claims, 2 Drawing Sheets

FIG. 2
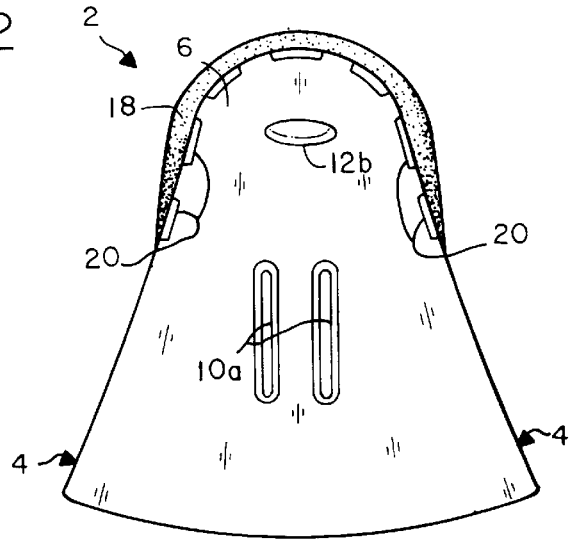
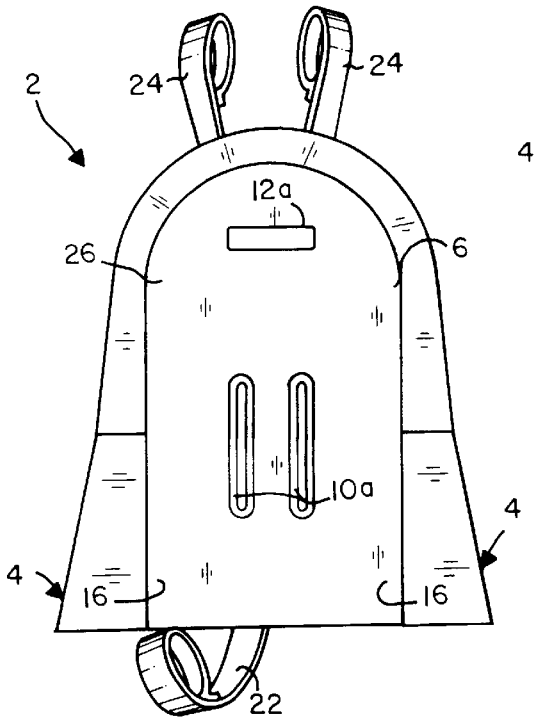
FIG. 3
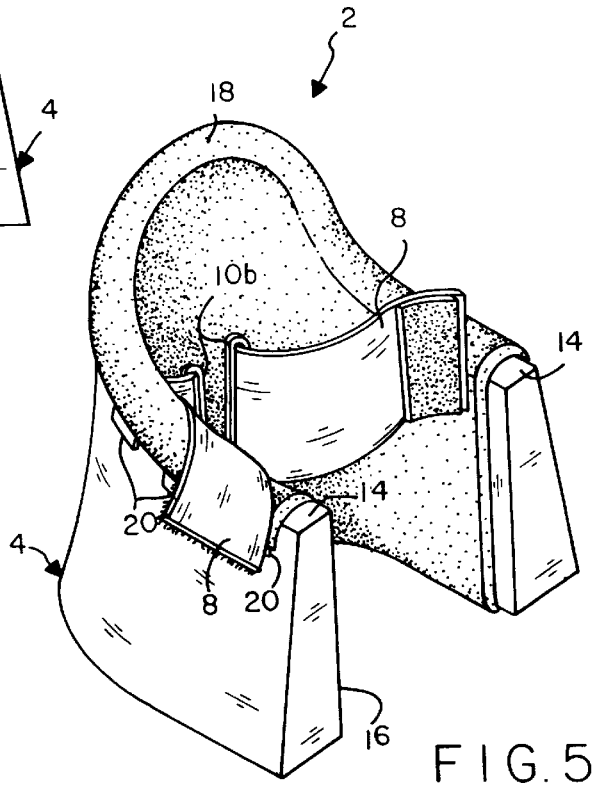
FIG. 5

INFANT PROPPING PLAY SEAT

BACKGROUND

1. Field of Invention

This invention relates to devices for supporting and restraining infants and babies, specifically to a device and method for use in vertically positioning infants and others who do not have the muscular control necessary to sit upright unassisted for extended periods of time. The device supports such infants in an essentially upright position so that the infants can more easily interact with people and objects adjacent to them. Applications may include, but are not limited to, use with infants between the approximate ages of three and eight months by workers in child care centers and nurseries so that the infants can be entertained by the activities of older children; by parents who have found themselves faced with the responsibility of raising twins, triplets, or even more infants at one time; by parents of a single infant when the parents need to accomplish tasks which would be impossible while holding a squirming or unhappy infant; and by those caring for children older than eight months who have medical conditions causing weakened muscular control that would not otherwise allow such children to sit upright on their own for extended periods of time.

2. Description of Prior Art

After an infant is two or three months old, it begins to acquire an awareness of its surroundings. Its vision becomes focused, it can begin to lift its head and look around, and in some instances three month old infants have made first attempts at rolling over. Yet this awareness is sometimes restricted and frustrated by a lack of muscular development, as well as the unavailability of an adult or older child to hold it or periodically move it to a new environment. Parents who want to encourage environmental interaction in an infant of this age, sometimes find themselves expending too much time and energy holding the infant in a vertical position on their lap or while standing, or frequently attending to the infant to change its position. The present invention would provide a means for propping up infants who enjoy sitting up and playing on the floor with toys, but cannot do so on their own and require the assistance of someone sitting behind them and holding them at the waist. With the present invention, an infant between the approximate ages of three and eight months can be propped up with toys and allowed to play independently. An adult or older children can also face the infant and hand it toys, as well as other objects, to entertain it.

An infant placed on its back can only see and directly interact with objects suspended above it, such as a mobile. Infants placed on their stomachs may raise their heads and look forward, but usually not for extended periods of time. Infants placed in rearwardly reclining positions in infant seats have an improved view of their environment over infants placed upon flat surfaces, but infants so placed in infant seats are still restricted in their ability to interact with nearby people and objects. Swings are also known to entertain infants, and even lull them to sleep, but unless the infants are put to sleep, they tend to tire of their isolated position. Also, children's booster and play seats, which are primarily designed for children who can sit upright unassisted, are ineffective to accomplish all of the functions of the present invention since they generally do not have a sufficiently wide restraining strap to support an infant during lateral reaching and which also prevents it from falling forward into an uncomfortable, non-interactive, and non-recoverable position; flexible padding configured as in the present invention to help support the infant in an upright position; sufficiently low sides to provide room for lateral reaching by the infant; and a sufficiently tall back to provide the necessary head and neck support for infants and others who cannot otherwise support their heads unaided for extended periods of time. Many booster and play seats also feature detachable front trays and interchangeable seat members of differing height dimensions which are unnecessary to fulfill the function of the present invention. Also, since booster seats and play seats only have narrow lap belts, infants without the muscular control to sit unaided for extended periods of time tend to fall forward in such seats into uncomfortable, non-recoverable positions. It is not known to have a bottomless infant support and restraining device which allows an infant between the approximate ages of three and eight months to sit upright on a flat surface near to an adult or other object so that an infant without the muscular development or control necessary to remain upright unassisted for extended periods of time can do so to actively and safely interact with its immediate surroundings.

SUMMARY OF INVENTION—OBJECTS AND ADVANTAGES

It is the primary object of this invention to provide an infant supporting and restraining play seat which comfortably and safely props an infant between the approximate ages of three and eight months into an upright position so that it can more effectively interact with its immediate surroundings. It is also an object of this invention to provide an infant supporting and restraining play seat which is configured so that the infant placed therein cannot fall forward and become stuck in an uncomfortable, non-interactive and non-recoverable position. A further object of this invention is to provide an infant supporting and restraining play seat that is sufficiently lightweight for transport yet designed with a flared-out lower outside edge so that abrupt movement by an infant placed therein does not cause the device to move unpredictably backward or laterally across the essentially flat surface supporting it. It is also an object of this invention to provide an infant supporting and restraining play seat that has side surfaces approximately one-half the height of its back surface so that an infant placed therein can have lateral reaching access to objects placed immediately adjacent thereto. A further object of this invention is to provide an infant supporting and restraining play seat that has a built-in handle or other type of manipulating means to aid in easy transport and positioning of the device. It is also an object of this invention to provide an infant supporting and restraining play seat that has a slightly rearwardly inclined inside back surface so that the padding placed against it will not cause an infant placed thereagainst to be unduly pushed forward. It is a further object of this invention to provide an infant supporting and restraining play seat that is made from washable materials.

As described herein, properly manufactured and used, the present invention would allow a person responsible for the safety and well-being of an infant between the ages of approximately three and eight months to alternatively place that infant in an upright position so that an infant who has not yet developed the muscular control to sit vertically unassisted for extended periods of time can safely do so and as a result be able to more directly interact with its environment than if it were placed on its back or stomach, or within the confines of a swing or a reclining infant seat. It is contemplated for the invention to have a rigid U-shaped support, flexible padding positioned against the inside surfaces of the U-shaped support, and a wide chest strap connected through both the padding and the back surface of the U-shaped support. It is also contemplated for the inside side surfaces of the U-shaped support to be vertical and its inside back surface to be slightly rearwardly inclined so that the padding placed against the inside back surface does not push an infant seated therein into an uncomfortable, non-interactive, and non-recoverable forward position. Since the sides of the U-shaped support are contemplated to have approximately one-half of the height dimension of its back, the infant using the present invention can easily reach laterally to interact with people and objects placed adjacent thereto. It is contemplated for the present invention to be made from lightweight, washable materials, and for the lower outside surface of the U-shaped support to flare outwardly to form a wedged configuration so that abrupt infant movement cannot cause the U-shaped support to move unpredictably backwards or laterally across the essentially flat surface upon which it is positioned. The chest strap is contemplated to be sufficiently wide to comfortably support the infant without binding it, yet allow the infant sufficient lateral reaching room for successful interaction with objects placed adjacent to it. The chest strap may comprise stretchable materials as long as the stretchable materials do not allow the infant to fall forward into an uncomfortable non-interactive position from which it may not have the muscular development to recover. A built-in handling means for one-handed use, to assist in maneuvering and transporting the U-shaped support is also contemplated but optional, such as a cutout through the back surface of the U-shaped support near to its top edge which has sufficient width dimension for at least two human adult fingers to be comfortably inserted therethrough. However, the type of built-in handling means used is not critical and may comprise other structures, such as a depression or groove in the outside back surface of the U-shaped support near to its top edge; or a small flange or loop rearwardly projecting from the outside back surface of the U-shaped support near to its top edge and of sufficient width dimension for at least two human adult fingers to be comfortably inserted thereagainst for lifting and transporting the present invention to other locations. When no handling means is present, it is contemplated that a user would employ two hands to comfortably take hold of opposing surfaces of the present invention so as to lift and transport it to a new location. Also, although not limited thereto, in the preferred embodiment it is contemplated for the U-shaped support of the present invention to be made from plastic materials as a rigid one-piece unit through molded construction.

The description herein provides preferred embodiments of the present invention but should not be construed as limiting the scope of the infant propping play seat invention. For example, variations in the width of the chest straps used, the amount of elasticity in the stretchable material comprising the chest straps, the type of fastener used to secure the chest strap, the type of flexible material used for the padding, the means by which the padding attaches to the U-shaped support, and the distance separating the elongated slots in the U-shaped support and padding through which the chest straps are positioned, other than those shown and described herein, may be incorporated into the present invention. Thus the scope of the present invention should be determined by the appended claims and their legal equivalents, rather than the examples given.

BRIEF DESCRIPTION OF THE DRAWINGS

FIG. 2 is a back view of the U-shaped support of the present invention having two central slots vertically positioned through its back surface at a spaced-apart distance from one another, padding which is attached to the upper portion of its outside back surface with fasteners, an outwardly flared outside bottom edge, and a horizontally oriented groove in the upper part of its back surface for use as a handle in positioning and manipulating the invention.

FIG. 3 is a front view of the present invention having a U-shaped support with an outwardly flared outside bottom edge, two central slots vertically positioned through the back surface of the U-shaped support at a spaced-apart distance from one another, and a handle comprising a horizontally oriented cutout through the upper part of the back surface, a crotch strap attached to the bottom edge of the U-shaped support, and two shoulder straps attached to the top edge of the U-shaped support.

FIG. 5 is a perspective view of the present invention having a U-shaped support with an outwardly flared outside bottom edge, padding covering the inside back surface and inside side surfaces of the U-shaped support, and a wide chest strap attached through vertical slots in the central portion of the padding to the U-shaped support.

DETAILED DESCRIPTION OF PREFERRED EMBODIMENTS

Figure 1:
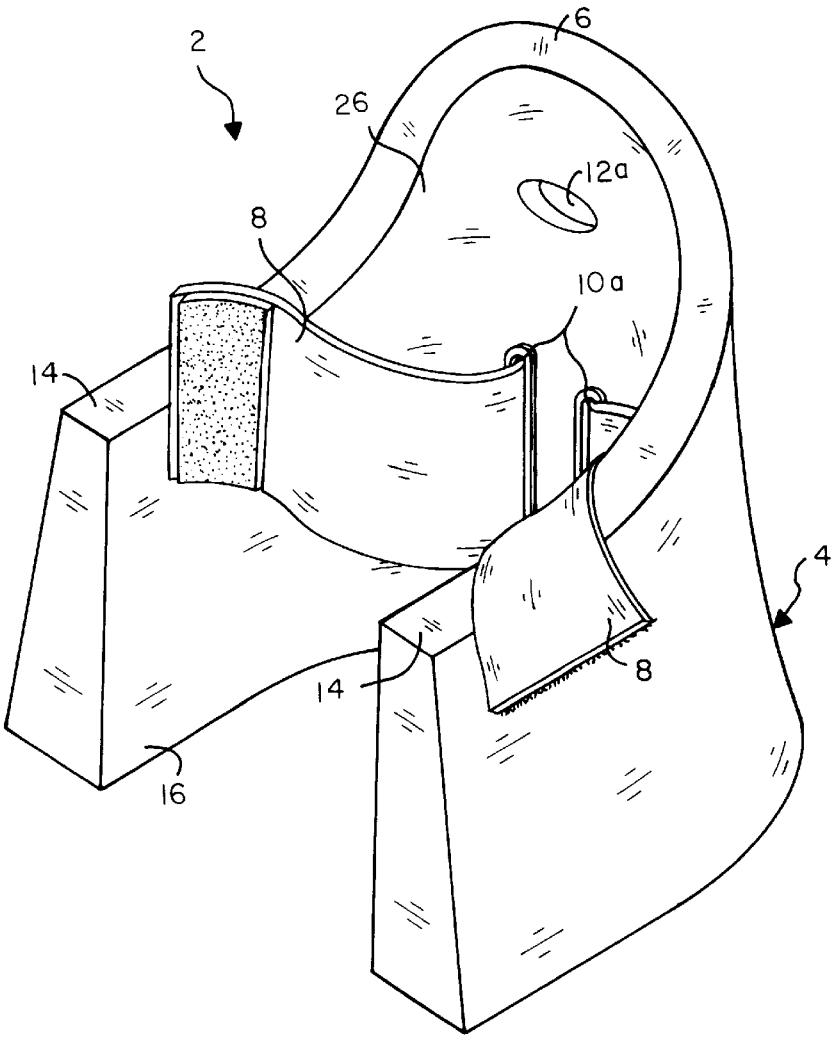
FIG. 1 is a perspective view of the present invention having a U-shaped support with an outwardly flared outside bottom edge, a horizontally oriented oval cutout through the upper part of its back surface for use as a handle, and a wide chest strap attached through the central portion of its back surface.

FIG. 1 shows a preferred embodiment of the present invention having a rigid U-shaped support 2 with two side members 14 and a centrally positioned back member 6 connected therebetween, each being configured for closely surrounding and supporting an infant (not shown) or other person (not shown) not having the muscular control to sit upright unassisted for extended periods of time. FIG. 1 also shows U-shaped support 2 having a flared-out bottom outside edge 4 which helps to prevent abrupt occupant movement from causing U-shaped support 2 to move unpredictably backwards or laterally. FIG. 1 further shows back member 6 upwardly extending beyond side members 14. It is important that back member 6 have sufficient height dimension to provide head and neck support for occupants (not shown) of U-shaped support 2. FIG. 1 also shows two vertically oriented slots 10*a* centrally positioned through back member 6 at a spaced-apart distance from one another, a handle 12*a* positioned through the upper part of back member 6, and two ends of a wide chest strap 8 each attached through back member 6 through one vertical slot 10*a*. In the preferred embodiment it is contemplated for slots 10*a* to have a vertical dimensional slightly longer than the width dimension of chest strap 8 so that chest strap 8 has the adjustment room within slots 10*a* to provide comfortable support around infants of differing heights and girth. FIG. 1 further shows U-shaped support 2 having an inside side surface 16 which is substantially vertical and an inside back surface 26 which is slightly rearwardly inclined. It is contemplated for U-shaped support 2 to be rigidly constructed with the height dimension of back member 6 being approximately twice the height dimension of side members 14. The configuration of the upper portion of back member 6 is not critical and although it is shown to have a rounded configuration in FIG. 1, it is also contemplated for the upper portion of back member 6 to have other configurations, including one that appears more flattened and square, such as that shown in FIG. 3.

Figure 4:
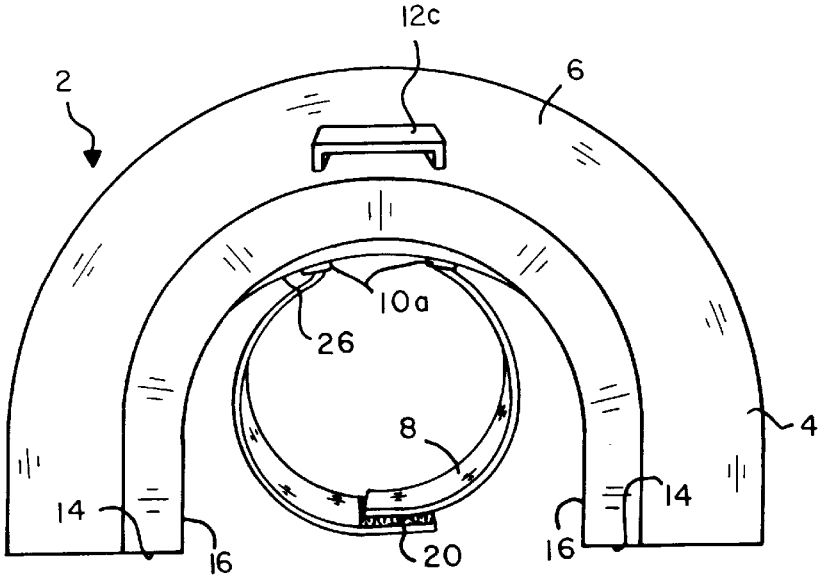
FIG. 4 is a top view of the present invention having a U-shaped support with an outwardly flared outside bottom edge, a slightly rearwardly inclined inside back surface, the ends of a chest strap attached through the inside back surface at a spaced-apart distance from one another, and a handle having the configuration of a loop protruding rearwardly from the upper part of the U-shaped support.

Also, neither the presence of handle 12*a*, nor its configuration, is critical to the present invention. Without handle 12*a* it is contemplated that a user (not shown) would grasp onto two opposing surfaces of U-shaped support 2 to lift and transport the present invention to a new location. Although FIG. 1 shows handle 12*a* comprising a horizontally oriented oval cutout through back member 6, it is also contemplated for handle 12*a* to comprise a horizontally oriented square or rectangular cutout through back member 6 and for the handle of the present invention to comprise other configurations, such as a depression or groove in the upper part of back member 6 as shown in FIG. 2 as 12*b*; a loop rearwardly protruding from the outside surface of back member 6 as shown in FIG. 4 as 12*c*; or a small flange (not shown) rearwardly protruding from the outside surface of back member 6. Also, it is not critical for handles 12*a*, 12*b*, or 12*c* to be only positioned on the upper part of back member 6 and in the preferred embodiment it is contemplated for handles 12*a*, 12*b*, and 12*c* to be placed in any convenient position which allows U-shaped support to be easily manipulated and balanced during transport. Although not shown in FIG. 1, but shown in FIGS. 2 and 5, it is contemplated for U-shaped support 2, when vertically propping an infant (not shown), to be used with padding 18 positioned against inside back surface 26 and inside side surfaces 16.

Although not shown in FIG. 1, in the preferred embodiment it is contemplated for chest strap 8 to have a minimum width of approximately three inches, with its preferred width ranging between three and four inches. Chest strap 8 can be made of differing materials, however, it is preferred that such materials be strong, durable, and washable. Although chest strap 8 could be made from plastic materials, in the preferred embodiment it is contemplated for chest strap 8 to comprise stretchable materials, however, such materials cannot be too stretchable so as to allow an infant (not shown) to fall forward into an uncomfortable, non-interactive, and non-recoverable position. The stretchable materials would also allow the infant firm but adjustable support when it reaches laterally to interact with nearby people and objects (not shown). It is also contemplated for both portions of chest strap 8 to comprise an easily releasable fastening means, such as but not limited to the hook-and-pile fasteners shown as number 20 in FIG. 4, snaps, hooks, or inwardly depressable side-release buckles so that chest strap 8 may be adjustable to securely hold infants of differing girth in an essentially vertical and interactive position. An adjustable chest strap 8 also allows the present invention to easily accommodate the expected growth of each infant until it can sit upright for extended periods of time on its own. Although the type of materials used for U-shaped support 2 are not critical, in the preferred embodiment it is contemplated for U-shaped support 2 to be made as a rigid one-piece unit from plastic materials through molded construction.

FIG. 2 shows the present invention having U-shaped support 2 with flared-out bottom outside edge 4, a horizontally oriented handle 12*b* in the form of a groove in the upper part of the outside surface of back member 6, and two vertical slots 10*a* centrally positioned through back member 6 at a spaced-apart distance from one another. In the preferred embodiment it is contemplated for this spaced-apart distance to have a maximum dimension of between three and four inches. In addition, FIG. 2 shows padding 18 connected over the upper portion of back member 6 with fasteners 20. Although in FIG. 2 fasteners 20 are clearly visible, in the preferred embodiment it is contemplated for fasteners 20 to be positioned underneath padding 18 so that fasteners 20 remain substantially hidden from view. However, it is not contemplated for the present invention to be limited to padding 18 which is connected to back member 6 by fasteners, and although not shown it is also contemplated for padding 18 to be connected to back member 6 by other means, such as by padding having a rearwardly positioned inverted pocket attached to its upper surface, with the inverted pocket having a configuration allowing it closely fit over the upper portion of back member 6. Although not critical, it is preferred that padding 18 be separable from U-shaped support 2 for ease in cleaning both padding 18 and U-shaped support 2. If fasteners 20 are employed, the type of fastener 20 used is not critical, however, it is contemplated for fasteners 20 to be easily releasable so that an undue amount of time is not spent separating padding 18 from U-shaped support 2. Fasteners 20 can comprise one component which non-destructively attaches to the flexible material of padding 18, such as a clip (not shown), or multiple components, at least one of which is attached to the outside surface of back member 6 and another of which is attached to padding 18, such as the hook-and-pile type of fasteners shown in FIG. 2.

FIG. 3 shows the present invention having U-shaped support 2 with flared-out bottom outside edge 4, a horizontally oriented handle 12*a* configured as a cutout through the upper part of back member 6, and two vertical slots 10*a* centrally positioned through back member 6 at a spaced-apart distance from one another. In FIG. 3 the configuration of handle 12*a* appears more rectangular than the oval shape shown in FIG. 1, however, the shape of cutout handle 12*a* is not critical to the present invention as long as the shape allows for the insertion of at least two adult human fingers. FIG. 3, also shows side surfaces 16 being vertically oriented to help securely hold an infant or other occupant (not shown) in a substantially vertical position. Although not readily visible in FIG. 3, it is contemplated for inside back surface 26 to be slightly rearwardly inclined so that the use of padding 18, as shown in FIGS. 2 and 5, does not place an infant (not shown) in an unduly forward position. FIG. 3 further shows the optional use of a crotch strap 22 connected centrally to the bottom edge of back member 6 and the optional use of shoulder straps 24 connected laterally to the upper edge of back member 6. Crotch strap 22 and shoulder straps 24 can be permanently or detachably connected to U-shaped support 2. It is contemplated for the distal ends of crotch strap 22 and shoulder straps 24 to have connection means, such as an end loop, of sufficient dimension for engagement with chest strap 8. It is also contemplated for crotch strap 22 and shoulder straps 24 to be required only when the present invention is used to support unusually active occupants (not shown) or occupants with atypical needs. It is also contemplated for crotch strap 22 and shoulder straps 24 to be adjustable in length. Although shoulder straps 24 could have the same maximum width dimension as chest strap 8, it is contemplated for crotch strap 22 to have a width dimension that is narrower than that of chest strap 8.

FIG. 4 shows the present invention having U-shaped support 2 with flared-out bottom outside edge 4 and slightly rearwardly inclined inside back surface 26. FIG. 4 also shows chest strap 8 attached to inside back surface 26 and side members 14 having substantially vertical inside side walls 16. FIG. 4 further shows chest strap 8 comprising quick-release fastener 20. Although the type of fastener 20 used is not critical, in the preferred embodiment it is contemplated for fastener 20 to comprise a hook-and-pile type of fastener, or a inwardly depressable side-release buckle. FIG. 4 also shows a handle 12*c* having the configuration of an elongated loop horizontally connected to the upper outside surface of back member 6 and protruding rearwardly therefrom.

FIG. 5 shows a preferred embodiment of the present invention having U-shaped support 2 with flared-out bottom outside edge 4 and padding positioned against U-shaped support 2. Padding 18 is shown to have two vertically oriented slots 10*b* centrally therethrough. FIG. 5 also shows inside side surfaces 16 of U-shaped support 2 being substantially covered by padding 18. FIG. 5 further shows the edges of padding 18 being attached to the outside surface of U-shaped support 2 with a plurality of fasteners 20. Although fasteners 20 are visible in FIG. 5, in the preferred embodiment it is contemplated for fasteners 20 to be positioned underneath the edges of padding 18 so as to be substantially hidden from view. Also, it is contemplated for the embodiment shown in FIG. 5 to have its padding 18 connected to back member 6 by either additional fasteners 20, as shown in FIG. 2, or by the inverted pocket discussed herein above. FIG. 5 also shows two ends of chest strap 8 each attached through one slot 10*b*. Although not shown in FIG. 5, it is contemplated for chest straps 8 to also be attached to, or otherwise supported by, U-shaped support 2. In the preferred embodiment it is contemplated for slots 10*b* to have a vertical dimensional slightly wider than chest straps 8 to provide adjustment room within each slot 10*b* for chest strap 8 to reposition itself to comfortably support occupants (not shown) of differing heights and girth. FIG. 5 further shows U-shaped support 2 having an inside side surface 16 which is substantially vertical.

To use the present invention for vertically propping an infant (not shown) between the approximate ages of three and eight months, one would first position U-shaped support 2 upon an essentially flat surface (not shown). Handle 12*a*, 12*b*, or 12*c* could be employed by a user to manipulate U-shaped support 2 with one hand into a desired position, although manipulating U-shaped support 2 with two hands by grasping opposed surfaces of U-shaped support 2 is also contemplated. Padding 18 could then be positioned against inside side surfaces 16 and inside back surface 26 to substantially cover them, with the edges of padding 18 being attached to U-shaped support 2 with a plurality of fasteners 20. In the alternative, the upper portion of padding 18 could be attached over back member 6 through use of an inverted pocket attached to the upper edge of padding 18. Slots 10*a* in U-shaped support 2 and slots 10*b* in padding 18 would be aligned so that chest strap 8 can be inserted through all slots 10*a* and 10*b*. It is not critical whether chest strap 8 is oriented so that its ends are connected with fastener 20 in front of padding 18 or behind back member 6. It is contemplated for fasteners 20 to comprise easily releasable fastening devices, such as but not limited to hook-and-pile type of fasteners, snaps, buckles, or clips, so that padding 18 and chest strap 8 will remain easily separable from U-shaped support 2 to allow periodic cleaning of padding 18 and chest strap 8. Once padding 18 and chest strap 8 are in place, an occupant (not shown) who does not have the muscular control to sit for extended periods of time unassisted, can be positioned against padding 18 between the inside side surfaces 16 and inside back surface 26. Chest strap 8 would be securely positioned around the infant's chest to prop the infant in a substantially upright position wherein the infant will not be able to fall forward into an uncomfortable, non-interactive, and non-recoverable position. Also, instead of relying on side members 16 to provide the lateral support of an infant, which would necessitate higher side members 14 than shown in FIGS. 2 and 5 and which would inhibit the reaching capability of the infant, in the preferred embodiment of the present invention chest strap 8 provides the lateral infant support necessary to allow the infant to reach over side members 14 without becoming stuck in a non-recoverable position. In the preferred embodiment it is also contemplated for the height of each side member 14 to be approximately one-half the height of back member 6, wherein an infant would be allowed to easily reach over side members 14 to interact with people and objects (not shown) placed close thereto. Although not shown, the present invention could be used to place an infant upon a table top, a bed, a sofa, an upholstered chair, or on a floor surface adjacent to an adult or older child, wherein the infant can be entertained by the activities of the people around it without having to be picked up and held in a vertical position by the adult or older child. Although not limited by such dimensions, in the preferred embodiment it is contemplated for back member 6 to have a height dimension of approximately twelve inches, side members 14 to each have a height dimension of approximately six inches, for the spaced-apart distance between the two inside side surfaces 16 to be approximately eleven inches, for the depth dimension of U-shaped support 2 from the front surfaces of side members 14 to the inside surface of back member 6 to be approximately eight inches, and for the maximum depth dimension of U-shaped support 2 from the front surfaces of side members 14 to the flared-out bottom edge of back member 6 to be approximately twelve inches. It is also contemplated for the preferred embodiment of the present invention to have larger dimensions when used to support older babies and children who as a result of medical conditions are not able to successfully sit up on their own for extended periods of time.

What is claimed is:

1. A propping and restraining device for assisting infants and others who do not have the muscular development and control to sit upright unaided upon an essentially flat surface, said device comprising a rigid bottomless U-shaped support having two substantially vertical inside side surfaces with a slightly rearwardly inclined inside back surface connected therebetween; flexible padding means attached to said U-shaped support and substantially covering said inside side surfaces and said inside back surface; a chest strap attached centrally to said inside back surface; a first attachment means for connecting said padding to said U-shaped support; and a second attachment means to connect said chest strap to said U-shaped support; said U-shaped support also having a flared-out outside bottom edge of sufficient depth dimension to prevent abrupt movement of an occupant from causing said U-shaped support to move unpredictably backwards and laterally across said essentially flat surface; and said two inside side surfaces each having a height dimension approximately one-half that of said inside back surface so that infants or other persons unable to sit upright unaided can reach laterally over said inside side surfaces to easily interact with people and objects close thereto without falling forward into uncomfortable, non-interactive, and non-recoverable positions while said chest strap allows for lateral reaching.

2. The device of claim 1 wherein said U-shaped support is made as a one-piece unit from plastic materials through molded construction.

3. The device of claim 1 further comprising a back member and wherein said back member has a height dimension of approximately twelve inches, said side members each have a height dimension of approximately six inches, said two side members are spaced apart from one another approximately eleven inches, and said chest strap has a minimum width dimension of approximately three inches.

4. The device of claim 1 wherein said chest strap is made from stretchable material.

5. The device of claim 1 further comprising a crotch strap centrally connected to said U-shaped support and configured for engagement with said chest strap.

6. The device of claim 1 further comprising at least one shoulder strap laterally connected to said U-shaped support and configured for engagement with said chest strap.

7. The device of claim 1 wherein said second attachment means comprises a plurality of vertically oriented slots centrally positioned through said inside back surface of said U-shaped support and said padding.

8. The device of claim 1 wherein said first attachment means comprises a plurality of fasteners.

9. The device of claim 8 wherein said fasteners are selected from a group consisting of clips and hook-and-pile types of fasteners.

10. The device of claim 1 wherein said chest strap has two distal ends and said distal ends are connectable to one another with at least one easily releasable fastener.

11. The device of claim 10 wherein said easily releasable fastener comprises a fastener selected from a group consisting of hook-and-pile fasteners, snaps, and inwardly depressable side-release buckles.

12. The device of claim 1 further comprising a handle configured for allowing said U-shaped support to be manipulated and transported in a balanced manner.

13. The device of claim 12 further comprising an outside back surface and wherein said handle is selected from a group consisting of a horizontally oriented oval cutout centrally positioned through said U-shaped support, said oval cutout having sufficient width and height dimensions to comfortably allow insertion therethrough of at least two human adult fingers; a horizontally oriented rectangular cutout centrally positioned through said U-shaped support, said rectangular cutout having sufficient width and height dimensions to comfortably allow insertion therethrough of at least two human adult fingers; a groove centrally positioned in said outside back surface, said groove having sufficient width and height dimensions to comfortably allow insertion therein of at least two human adult fingers; and a loop connected to said outside back surface and rearwardly protruding therefrom, said loop also having sufficient width and height dimensions to comfortably allow insertion therein of at least two human adult fingers.

14. A method for restraining and vertically positioning infants and other occupants who do not have the muscular development and control to sit upright unaided upon an essentially flat surface, said method comprising the steps of providing a rigid bottomless U-shaped support with a back member having sufficient height to support the head of an occupant and side members having a height dimension approximately one-half that of said back member, a quantity of flexible padding, a wide chest strap, and a plurality of quick-release fasteners; manipulating said U-shaped support into a desired position upon an essentially flat surface; positioning said padding against the inside surfaces of said back member and said side members of said U-shaped support to substantially cover them; using some of said quick-release fasteners to attach the edges of said padding to said U-shaped support; making a plurality of vertical slots centrally through said U-shaped support; making a similar number and pattern of vertical slots centrally through said padding; aligning said slots in said U-shaped support with said slots in said padding; inserting said chest strap through all of said slots in said U-shaped support and said padding; attaching at least one of said quick-release fasteners to said chest strap; placing an occupant who does not have the muscular control to sit for extended periods of time unassisted against said padding; and using said fasteners to secure said chest strap around said occupant to prop said occupant in a substantially upright position wherein said occupant cannot fall forward into an uncomfortable and non-recoverable position and wherein said occupant is also able to easily reach laterally to interact with objects and people placed nearby.

15. The method of claim 14 wherein said step of providing said plurality of fasteners further comprises the step of providing a fastener selected from a group consisting of a plurality of hook-and-pile type of fasteners, a plurality of clips, a plurality of snaps, and a plurality of inwardly depressable side-release buckles.

16. The method of claim 14 further comprising the steps of providing a crotch strap, attaching one end of said crotch strap to said U-shaped support, and removably connecting the other end of said crotch strap to said chest strap.

17. The method of claim 14 further comprising the steps of providing at least one shoulder strap, attaching one end of said shoulder strap to said U-shaped support, and removably connecting the other end of said shoulder strap to said chest strap.

18. The method of claim 14 further comprising the steps of providing at least one handle configured for manipulating said U-shaped support in a balanced manner, connecting said handle to said U-shaped support, and wherein said step of providing said handle further comprises the step of providing a handle selected from the group consisting of a horizontally oriented oval cutout having sufficient width and height dimensions to comfortably allow insertion therethrough of at least two human adult fingers; a groove having sufficient width and height dimensions to comfortably allow insertion therein of at least two human adult fingers; and a rearwardly extending loop having sufficient width and height dimensions to comfortably allow insertion therein of at least two human adult fingers.

19. The method of claim 14 wherein said step of providing said chest strap further comprises the step of providing a chest strap made from stretchable material.

* * * * *